US007002564B1

(12) United States Patent
Greenberg

(10) Patent No.: US 7,002,564 B1
(45) Date of Patent: Feb. 21, 2006

(54) FAILSAFE DISPLAY OF FRAME LOCKED GRAPHICS

(75) Inventor: Robert Y. Greenberg, Portland, OR (US)

(73) Assignee: Pixelworks, Inc., Tualatin, OR (US)

( * ) Notice: Subject to any disclaimer, the term of this patent is extended or adjusted under 35 U.S.C. 154(b) by 434 days.

(21) Appl. No.: 10/092,180

(22) Filed: Mar. 6, 2002

Related U.S. Application Data

(60) Provisional application No. 60/273,903, filed on Mar. 6, 2001.

(51) Int. Cl.
*G09G 5/00* (2006.01)

(52) U.S. Cl. ..... 345/204; 345/89; 348/443

(58) Field of Classification Search ..... 345/698, 345/699, 204, 89; 348/443
See application file for complete search history.

(56) References Cited

U.S. PATENT DOCUMENTS

| | | | | |
|---|---|---|---|---|
| 5,742,349 | A * | 4/1998 | Choi et al. | 348/443 |
| 6,054,980 | A * | 4/2000 | Eglit | 345/204 |
| 6,219,023 | B1 * | 4/2001 | Kim | 345/698 |
| 6,222,589 | B1 * | 4/2001 | Faroudja et al. | 348/448 |
| 6,304,253 | B1 * | 10/2001 | Sung et al. | 345/418 |
| 2002/0158868 | A1 * | 10/2002 | Imaizumi et al. | 345/421 |

* cited by examiner

*Primary Examiner*—Alexander Eisen
*Assistant Examiner*—Kimnhung Nguyen
(74) *Attorney, Agent, or Firm*—Marger Johnson & McCollom

(57) ABSTRACT

The invention describes a system including a failsafe mechanism adapted to visually display frame locked digital image data and a method therefor. The system receives input image data at an input vertical refresh rate and displays the image data at a vertical refresh rate that is a predetermined fraction of the input vertical refresh rate.

16 Claims, 4 Drawing Sheets

FAILSAFE DISPLAY OF FRAME LOCKED GRAPHICS

This application claims priority from U.S. Provisional Patent Application Ser. No. 60/273,903 filed Mar. 6, 2001 and U.S. patent application Ser. No. 09/826,493, titled FAILSAFE DISPLAY OF FRAME LOCKED GRAPHICS SYSTEMS, filed Apr. 4, 2001, both, in turn, claim priority from U.S. Provisional Patent Application No. 60/194,640, titled FAILSAFE DISPLAY OF FRAME LOCKED GRAPHICS SYSTEMS, filed Apr. 4, 2000.

BACKGROUND OF THE INVENTION

1. Field of the Invention

This invention relates to a system adapted to visually display digital image data and, more particularly, to a system including a failsafe mechanism adapted to visually display digital image data and a method therefor.

2. Description of the Prior Art

Digital image data is input to a system adapted to visually display digital image data on a display device. Digital image data is input to a frame locked system one frame at a time at a vertical refresh or frame rate. A frame is an image displayed for viewing on a display device or panel at one time, i.e., one frame of data fits on the display device screen or panel. Each frame includes a rectangular array of pixels. Each pixel has one or more values, for example, a gray scale luminance value for a monochrome display or red, green, and blue (RGB) luminance values for a color display. The resolution of the array, i.e., the number of horizontal and vertical pixels, is often referred to as an image frame resolution. Common display frame resolutions include that shown in Table 1 indicating, in the second and third columns, the number of pixels in the vertical and horizontal dimensions, respectively:

TABLE 1

| | | |
|---|---|---|
| VGA | 640 | 480 |
| SVGA | 800 | 600 |
| XGA | 1024 | 768 |
| SXGA | 1280 | 1024 |
| UXGA | 1600 | 1200 |
| HDTV | 1280 | 720 |

Display monitors must be refreshed many times per second. The refresh rate for a display device is measured in hertz (Hz) and is also called the vertical refresh rate, vertical frequency, vertical scan rate, or frame rate. Put differently, digital image data is input at an input frame rate. An input vertical refresh or frame rate is the rate at which a frame of data is received by the system. A display vertical refresh rate is the rate at which digital image data is provided to a display device for visually displaying the input image data. Common input and display vertical refresh rates include 60, 75, and 85 Hz and the like.

Where the display vertical refresh rate and/or resolution match the input vertical refresh rate and/or resolution, the frame of image data is displayed directly without issue. If, however, the input and display vertical refresh rates and/or the resolutions differ substantially, the image data might not be properly displayed on the display device. This is particularly true in frame locked systems where small line memories are commonplace since these line memories do not allow for full conversion of the input vertical refresh rate to a vertical refresh rate that matches the display vertical refresh rate.

When the input and display vertical refresh rates differ, the display device and, more particularly, the software that drives the display device might enter an unrecoverable error mode. For example, assume UXGA image data input at 85 Hz and a VGA display running at 60 Hz. In this circumstance, the system is incapable of displaying the image data. The VGA display device might go blank except perhaps for a single line error message that reads SYNCH ERROR or OUT OF RANGE.

A system reset will not generally cure the error because the system will continue to deliver image data at a display vertical refresh rate and/or resolution that exceeds the capability of the display device. The software and/or hardware driving the display device will not give a perplexed user a way of changing its settings to ensure the error does not recur.

Accordingly, a need remains for a system including a failsafe mechanism adapted to visually display digital image data and a method therefor.

BRIEF DESCRIPTION OF THE DRAWINGS

The foregoing and other objects, features, and advantages of the invention will become more readily apparent from the following detailed description of a preferred embodiment that proceeds with reference to the following drawings.

DETAILED DESCRIPTION OF THE PREFERRED EMBODIMENT

Figure 1:
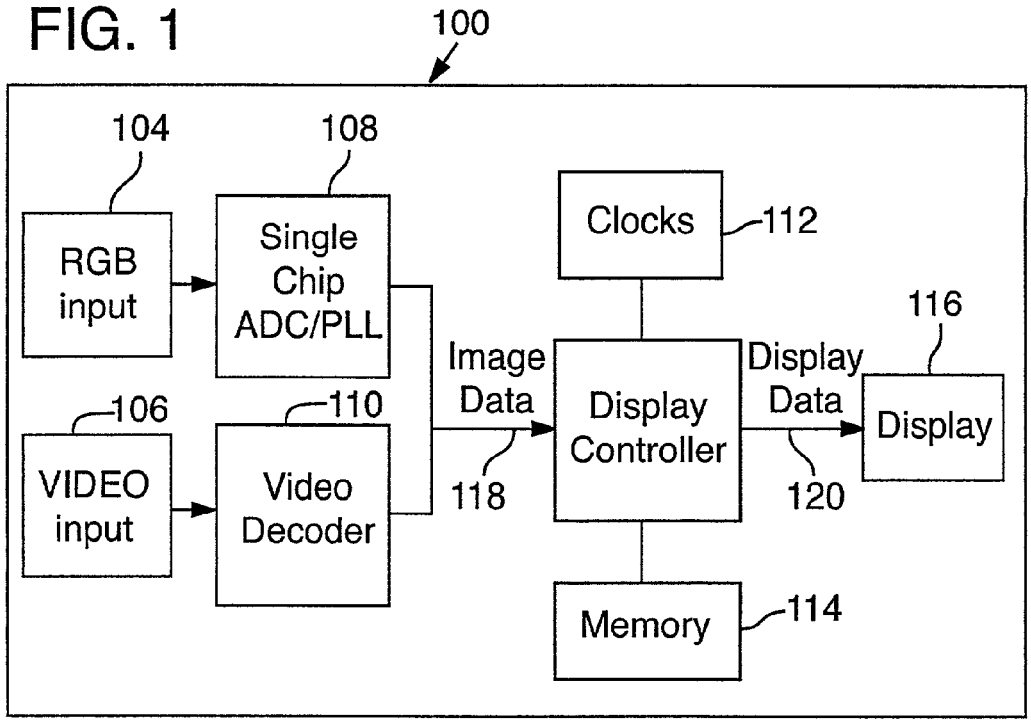
FIG. 1 is a block diagram of an embodiment of the system of the present invention.

Referring to FIG. 1, an embodiment of a system 100 for visually displaying digital images includes an analog-to-digital (ADC) converter or phase locked loop (PLL) circuit 108 for receiving an RGB analog input signal 104 from an image source (not shown). The ADC/PLL circuit 108 converts the analog input signal to digital image data 118 and provides the image data 118 to the display controller 102. Likewise, a video decoder 110 receives an analog video input 106 from an analog video source (not shown). The video decoder 110 converts the analog video input to digital image data 118 and provides the image data 118 to the display controller 102. A person of reasonable skill in the art should recognize that the image data 118 might be encoded in a variety of formats. All manner of encoding a digital image comes within the scope of the invention including RGB signals using 8, 6, or 4-bit luminance, red chroma, blue chroma (YCRB), and the like.

Display controller 102 processes image data 118 to generate display data 120. Display controller 102 provides the display data 120 to the display 116. Clocks 112 synchronize the display controller 102. The system 100 optionally includes memory 114. Memory 114 couples to the display controller 102 and stores bitmaps, scalar coefficients, and the like. In one embodiment, memory 102 includes read-only and random access type memories (not shown). ADC/PLL circuit 108, video decoder circuit 110, clocks 112, and memory 114 are well known to a person of reasonable skill in the art and will not be explained in further detail.

Figure 2:
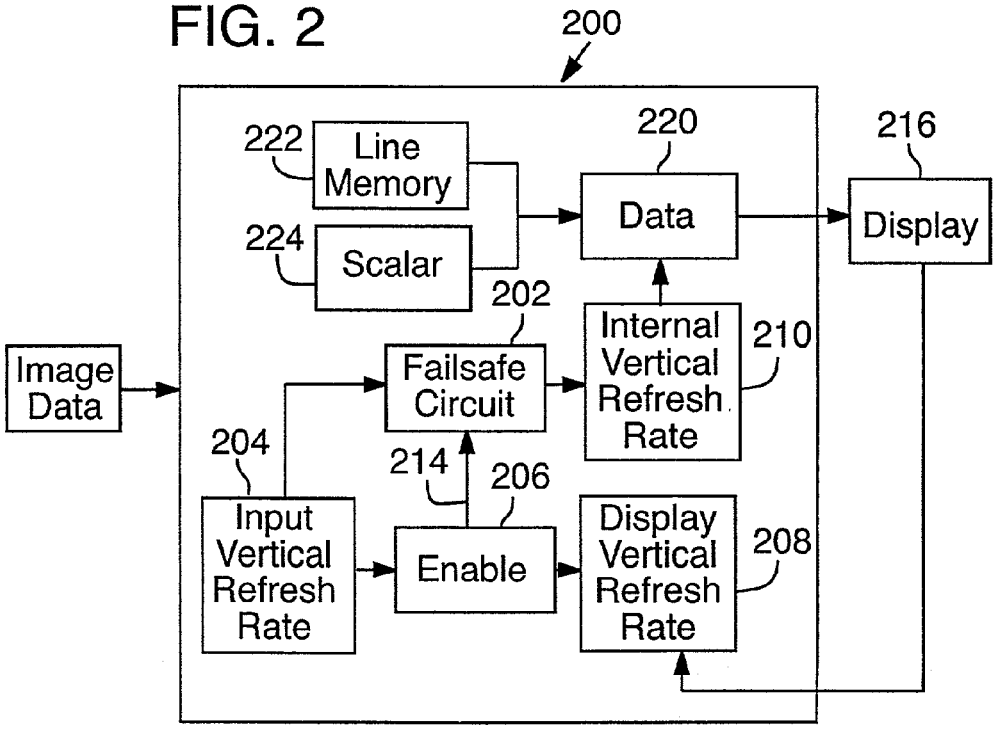
FIG. 2 is a block diagram of an embodiment of the display controller shown in FIG. 1.

Referring to FIG. 2, a display controller 200 provides data 220 to a display 216. Image data 218 includes data 220 and an input vertical refresh or frame rate 204. Examples of the input vertical refresh rate 204 are 60, 75, 85 Hz, and the like.

The display 216 is any device capable of displaying data 220. The data 220 might, for example, be encoded in RGB signals (not shown) but the invention is not limited in this regard. The display 216 might be, for example, a pixelated display that has a fixed pixel structure. Examples of pixelated displays are a liquid crystal display (LCD) projector, flat panel monitor, plasma display (PDP), field emissive display (FED), electro-luminescent (EL) display, micro-mirror technology display, and the like.

Figure 5:
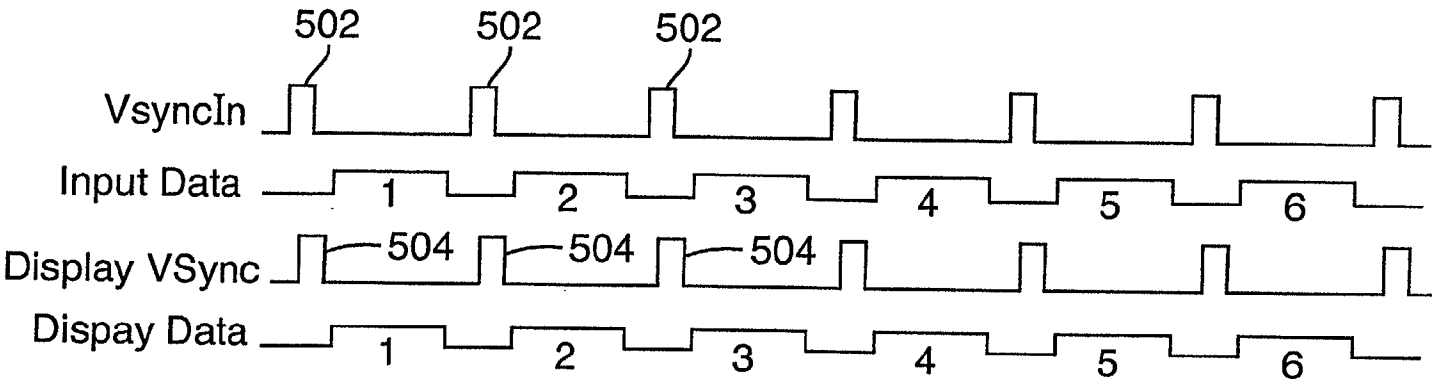
FIG. 5 is a timing diagram of the input vertical refresh rate and data and the internal vertical refresh rate and display data in a frame locked display system.

The display 216 is capable of displaying data 220 up to a display vertical refresh rate 208. Examples of the display vertical refresh rate 208 are 60, 75, 85 Hz, and the like. Referring additionally to FIG. 5, the display 216 properly displays the data 220 when the input vertical refresh rate 204 equals or is less than the display vertical refresh rate 208. As shown in FIG. 5, one input vertical refresh rate pulse 502 exists for every display vertical refresh pulse 504. The display 216, therefore, includes a vertical active time (not shown) that approximately matches the input vertical active time (not shown). As mentioned earlier, the display 216 is incapable of displaying the image data 218 when the input vertical refresh rate 204 exceeds the display vertical refresh rate 208.

The controller 200 includes an enable circuit 206. The enable circuit 206 compares the input vertical refresh rate 204 with the display vertical refresh rate 208. The enable circuit 206 asserts an enable signal 214 when the input vertical refresh rate 204 exceeds the display vertical refresh rate 208. A person of reasonable skill in the art should recognize that the enable circuit 206 might be implemented in a variety of manners including software and hardware, all encompassed within the scope of the present invention.

The failsafe circuit 202 generates an internal vertical refresh rate 210 by manipulating the input vertical refresh rate 204 responsive to the enable signal 214. The failsafe circuit 202 generates the internal vertical refresh rate 210 to be less than the input vertical refresh rate 204. The internal vertical refresh rate 210, for example, is a predetermined fraction, i.e., ¼, ⅓, ½, and the like, of the input vertical refresh rate 204. The failsafe circuit 202 provides the internal vertical refresh rate 210 to the display 216. The display 216, in turn, uses the internal vertical refresh rate 210 to synchronize its display of the data 220. By doing so, the failsafe circuit 202 allows for the display of a useful image, at full color depth, when the input refresh rate 204 exceeds the capability of the display 216. That is, when the input vertical refresh rate 204 is greater than the display vertical refresh rate 208.

Figure 3:
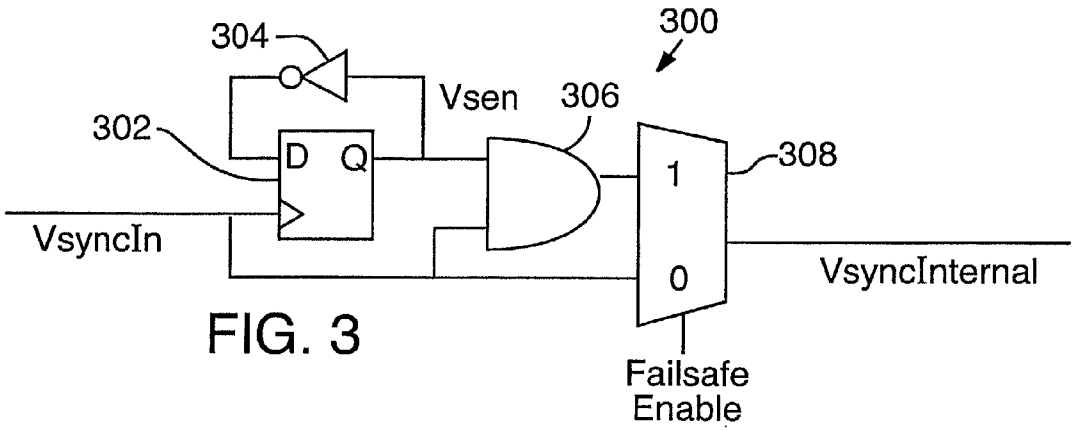
FIG. 3 is a schematic diagram of an embodiment of the failsafe circuit shown in FIG. 2.

FIG. 3 is a schematic diagram of an embodiment of the failsafe circuit 202 shown in FIG. 2. Referring to FIG. 3, a failsafe circuit 300 includes a flip flop 302, an inverter 304, an AND gate 306, and a multiplexer 308. The flip-flop 302 generates a signal VSEN responsive to the input vertical refresh rate signal VSYNCIN. The flip-flop 302 receives the input vertical refresh rate signal VSYNCIN at its clock input. The inverter 304 inverts the signal VSEN and provides it to an input terminal of the flip-flop 302. The AND gate 306 logically manipulates the signal VSEN and the internal vertical refresh rate signal VSYNCIN to thereby generate the internal vertical refresh rate signal VSYNCINTERNAL. The AND gate 306 provides the internal vertical refresh rate signal VSYNCINTERNAL to the multiplexer 308 that, in turn, outputs the VSYNCINTERNAL signal responsive to the FAILSAFE ENABLE signal.

Figure 4:
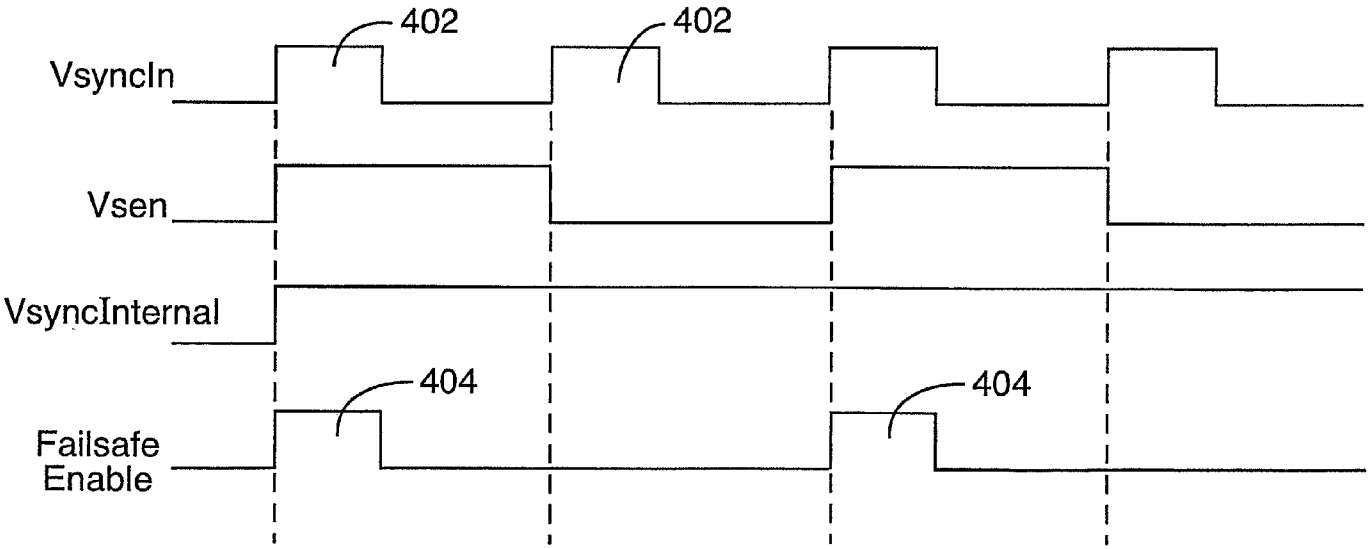
FIG. 4 is a timing diagram of failsafe circuit signals shown in FIG. 3.
Figure 6:
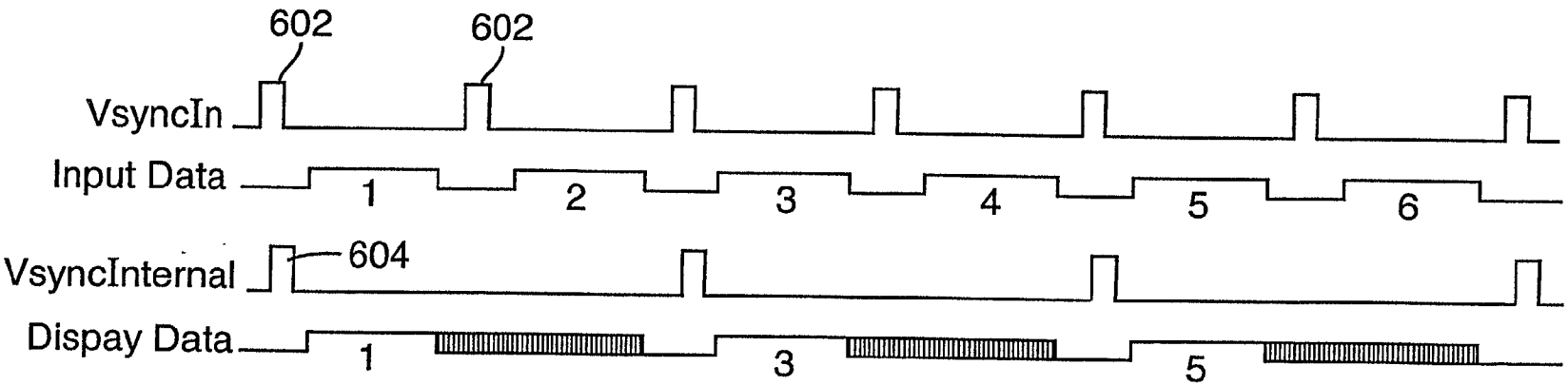
FIG. 6 is a timing diagram of the input vertical refresh rate and data and the internal vertical refresh rate and display data according to an embodiment of the present invention.

FIG. 4 is a timing diagram of an embodiment of the signals associated with the failsafe circuit 300 shown in FIG. 3. FIG. 6 is a timing diagram of the input vertical refresh rate and data and the internal vertical refresh rate and display data according to an embodiment of the failsafe circuit shown in FIG. 3. As shown in FIGS. 4 and 6, two input vertical refresh rate pulses 402 and 602 exist for every internal vertical refresh rate pulse 404 and 604, respectively. Put differently, the internal vertical refresh rate 210 (FIG. 2) is half the input vertical refresh rate 204 (FIG. 2) with the resulting output image being vertically compressed relative to the received image data 218 and filling a corresponding fraction, e.g., approximately ½, of the display 216. Thus, the display 216 includes a vertical active time approximately equal to two input vertical active times as shown by the shaded lines in FIG. 6.

A line memory 222 together with a scalar circuit 224 might further improve the size and/or quality of the image displayed on the display 216. Embodiments of the scalar circuit 224 include circuits that scale the image in a variety of manners including simple, temporal, and/or spatial interpolation, digital signal processing techniques, and/or using filters such as those described in U.S. Pat. No. 6,339,434 to West, herein incorporated by reference. The line memory 222 and scalar circuit are well known to a person of reasonable skill in the art and will not be discussed in further detail.

Since a plurality of input frames are displayed during one output frame, the failsafe circuit shown in FIG. 2 includes the following several possible display modes:

Display first—display the first input frame and discard other input frames received during a single output frame, for example, by filling the second input frame with black (where the internal refresh rate is half the input refresh rate). This mode is shown in FIG. 6.

Display last—display the last input frame and discard other input frames received during a single output frame, for example, by filling the first received input frames with black.

Display all—display both the input and output frames in a single output frame. In this case, the display 216 will show, for example, two half-height images where the internal vertical refresh rate 210 is half the input vertical refresh rate 204.

A person of reasonable skill in the art should recognize that other display modes are possible depending on the chosen relationship between the input and internal vertical refresh rates 204 and 210, respectively.

A person skilled in the art should recognize that the system provided above receives a color image represented by RGB signals at the input vertical refresh rate and generates an internal vertical refresh rate used by the display 216 to synchronize its display of the data 220. The display 216, therefore, vertically compresses data 220. By doing so, the user (not shown) avoids an irrecoverable error mode and has the opportunity to change the settings on the display system such that the input vertical refresh rate does not exceed the capabilities of the display, that is, does not exceed the display vertical refresh rate thereby ensuring that the display is capable of displaying a full color version of the image input.

An embodiment of the failsafe circuit 202 shown in FIG. 2 is integrated into a monolithic integrated circuit. Alternatively, any number of discrete logic and other components might implement the invention. A dedicated processor system that includes a microcontroller or a microprocessor might alternatively implement the present invention.

The invention additionally provides methods, which are described below. The invention provides apparatus that performs or assists in performing the methods of the invention. This apparatus might be specially constructed for the required purposes or it might comprise a general-purpose computer selectively activated or reconfigured by a computer program stored in the computer. The methods and algorithms presented herein are not necessarily inherently related to any particular computer or other apparatus. In particular, various general-purpose machines might be used with programs in accordance with the teachings herein or it might prove more convenient to construct more specialized apparatus to perform the required method steps. The required structure for a variety of these machines will appear from this description.

Useful machines or articles for performing the operations of the present invention include general-purpose digital computers or other similar devices. In all cases, there should be borne in mind the distinction between the method of operating a computer and the method of computation itself. The present invention relates also to method steps for operating a computer and for processing electrical or other physical signals to generate other desired physical signals.

The invention additionally provides a program and a method of operation of the program. The program is most advantageously implemented as a program for a computing machine, such as a general-purpose computer, a special purpose computer, a microprocessor, and the like.

The invention also provides a storage medium that has the program of the invention stored thereon. The storage medium is a computer-readable medium, such as a memory, and is read by the computing machine mentioned above.

This detailed description is presented largely in terms of block diagrams, timing diagrams, flowcharts, display images, algorithms, and symbolic representations of operations of data bits within a computer readable medium, such as a memory. Such descriptions and representations are the type of convenient labels used by those skilled in programming and/or the data processing arts to effectively convey the substance of their work to others skilled in the art. A person skilled in the art of programming may use this description to readily generate specific instructions for implementing a program according to the present invention.

Often, for the sake of convenience only, it is preferred to implement and describe a program as various interconnected distinct software modules or features, collectively also known as software. This is not necessary, however, and there may be cases where modules are equivalently aggregated into a single program with unclear boundaries. In any event, the software modules or features of the present invention may be implemented by themselves, or in combination with others. Even though it is said that the program may be stored in a computer-readable medium, it should be clear to a person skilled in the art that it need not be a single memory, or even a single machine. Various portions, modules or features of it may reside in separate memories or separate machines where the memories or machines reside in the same or different geographic location. Where the memories or machines are in different geographic locations, they may be connected directly or through a network such as a local access network (LAN) or a global computer network like the Internet®.

In the present case, methods of the invention are implemented by machine operations. In other words, embodiments of the program of the invention are made such that they perform methods of the invention that are described in this document. These may be optionally performed in conjunction with one or more human operators performing some, but not all of them. As per the above, the users need not be collocated with each other, but each only with a machine that houses a portion of the program. Alternately, some of these machines may operate automatically, without users and/or independently from each other.

Methods of the invention are now described. A person having ordinary skill in the art should recognize that the boxes described below may be implemented in different combinations, and in different order. Some methods may be used for determining a location of an object, some to determine an identity of an object, and some both.

Figure 7:
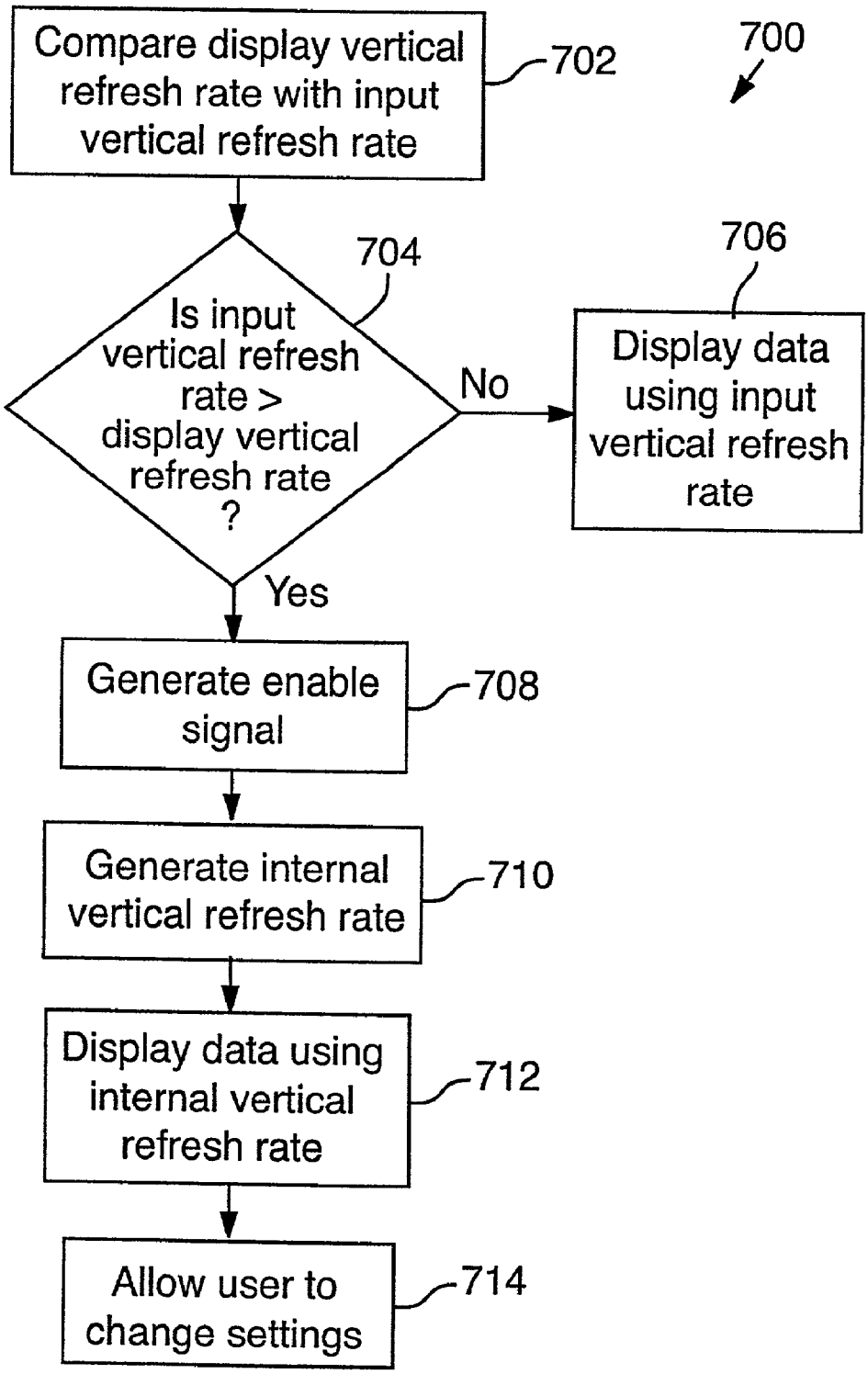
FIG. 7 is a flow diagram of an embodiment of the failsafe display method of the present invention.

FIG. 7 is a flowchart of an embodiment of the method of failsafe display 700 according to the present invention. Referring to FIG. 7, the method 700 compares the input vertical refresh rate with the display vertical refresh rate at 702. If the input vertical refresh rate does not exceed the display vertical refresh rate (704), the method 700 displays data without issue using the input vertical refresh rate (706). If the input vertical refresh rate exceeds the display vertical refresh rate, the method 700 generates an enable signal (708) and an internal vertical refresh rate (710). The internal vertical refresh rate is generated as described above with reference to FIGS. 2-6 and is, in one embodiment, a predetermined fraction of the input vertical refresh rate. The method 700 displays the data synchronized using the internal vertical refresh rate (712). By doing so, the method displays the data vertically compressed relative to the data received. At 714, the method allows a user to change the settings of his system to adjust to the input vertical refresh rate.

Having illustrated and described the principles of my invention in a preferred embodiment thereof, it should be readily apparent to those skilled in the art that the invention 20 can be modified in arrangement and detail without departing from such principles. I claim all modifications coming within the spirit and scope of the accompanying claims.

What is claimed is:

1. A display controller adapted to display image data received at an input vertical refresh rate on a display having a display vertical refresh rate, comprising:

a failsafe enable circuit to generate a failsafe enable signal responsive to the input vertical refresh rate; and a failsafe circuit to generate an internal vertical refresh rate responsive to the failsafe enable signal, the internal vertical refresh rate being a predetermined fraction of the input vertical refresh rate;

where the system controller operates responsive to one of a plurality of modes comprising:

a display first mode where a first frame of the image data is displayed on the display while other frames are discarded in a single output frame;

a display last mode where a last frame of the image data is displayed on the display while other frames are discarded in the single output frame;

a display all mode where all frames of the image data are displayed on the single output frame.

2. The display controller of claim 1 where the internal vertical refresh rate is provided to the display for displaying the image data at the internal vertical refresh rate.

3. The display controller of claim 1 where the failsafe enable circuit generates the failsafe enable signal responsive to a comparison of the input and display vertical refresh rates.

4. The display controller of claim 1 where the failsafe circuit comprises:

a flip-flop to generate a first signal responsive to the input vertical refresh rate;

an inverter to generate a second signal by inverting the first signal, the second signal being provided to the flip-flop;

a logic gate to generate the internal vertical refresh rate by logically manipulating the first signal and the input vertical refresh rate;

a multiplexer to provide the internal vertical refresh rate to an output terminal responsive to the failsafe enable signal.

5. The display controller of claim 1 where the internal vertical refresh rate is half the input vertical refresh rate.

6. The display controller of claim 1 where there exists two input vertical refresh rate pulses for every one internal vertical refresh rate pulse.

7. The display controller of claim 1 comprising:

a memory to store portions of the image data; and an image scalar to resize the image data stored in the memory.

8. A system for visually displaying digital images, comprising:

image signals provided to the system one frame at a time, the image signals having an input vertical refresh rate;

a display capable to display the image signals having a display vertical refresh rate;

a failsafe enable to identify when the input vertical refresh rate exceeds the display vertical refresh rate and generate an enable signal responsive to the identification;

a failsafe circuit to generate an internal vertical refresh rate a predetermined fraction of the input vertical refresh rate responsive to the enable signal;

where the internal vertical refresh rate is half the input vertical refresh rate;

where the failsafe circuit comprises:

a display first mode where a first input frame is displayed on a single output frame while a second input frame is discarded;

a display last mode where the second input frame is displayed on the single output frame while the first input frame is discarded; and display both mode where both the first and second input frames are displayed on the single output frame.

9. A failsafe circuit comprising:

a flip-flop adapted to generate a first signal responsive to an input vertical refresh rate;

an inverter adapted to invert the first signal;

a logic gate adapted to generate an internal vertical refresh rate by logically manipulating the first signal and the input vertical refresh rate, the internal vertical refresh rate being a factor of the input vertical refresh rate;

a multiplexer adapted to select the internal vertical refresh rate responsive to the enable signal; and a mode circuit adapted to generate a mode signal responsive to user input indicative of one of a plurality of modes;

wherein plurality of modes, comprises:

a display first mode wherein a first frame is received during a predetermined interval is displayed on a single output frame while other frames received during the predetermined time interval are discarded;

a display last mode where a last frame received during a predetermined time interval is displayed on the single output frame while other frames received during the predetermined time interval are discarded; and a display all mode where all frames received during the predetermined time interval are displayed on the single output frame.

10. The failsafe circuit of claim 9 where the factor is half.

11. The failsafe circuit of claim 9 where the failsafe circuit includes a mode circuit to generate a mode signal responsive to user input indicative of one of a plurality of modes.

12. A system for visually displaying digital images, comprising:

a display to display image signals having a display vertical refresh rate;

a failsafe enable to identify when the input vertical refresh rate exceeds the display vertical refresh rate and generate an enable signal responsive to the identification;

a failsafe circuit to generate an internal vertical refresh rate a predetermined fraction of the input vertical refresh rate responsive to the enable signal;

where the failsafe circuit operates in at least one of:

a display first mode where a first input frame is displayed on a single output frame while a second input frame is discarded;

a display last mode where the second input frame is displayed on the single output frame while the first input frame is discarded; or display both mode where both the first and second input frames are displayed on the single output frame.

13. The system of claim 12 where the failsafe circuit comprises:

a flip-flop to generate a first signal responsive to the input vertical refresh rate;

an inverter to invert the first signal;

a logic gate to generate the internal vertical refresh rate by logically manipulating the first signal and the input vertical refresh rate; and a multiplexer to select the internal vertical refresh rate responsive to the enable signal.

14. The system of claim 12 where the display displays the image signals at the internal vertical refresh rate.

15. The system of claim 12 where the internal vertical refresh rate is less than the display vertical refresh rate such that the image signals displayed on the display occupy less than a fill vertical length of the display.

16. The system of claim 12 where the internal vertical refresh rate is half the input vertical refresh rate.

* * * * *

UNITED STATES PATENT AND TRADEMARK OFFICE

CERTIFICATE OF CORRECTION

PATENT NO. : 7,002,564 B1
APPLICATION NO. : 10/092180
DATED : February 21, 2006
INVENTOR(S) : Greenberg It is certified that error appears in the above-identified patent and that said Letters Patent is hereby corrected as shown below:

At column 8, line 4, please replace “wherein” with --where--

At column 8, line 5, please replace “wherein” with --where--

At column 8, line 58, please replace “a fill vertical” with --a full vertical--

Signed and Sealed this

Twelfth Day of December, 2006

JON W. DUDAS
*Director of the United States Patent and Trademark Office*